United States Patent [19]

Borgis

[11] Patent Number: 4,888,519

[45] Date of Patent: Dec. 19, 1989

[54] ELECTRIC LAMP AND METHOD OF MANUFACTURING SAME

[75] Inventor: Livio Borgis, S. Antonino, Italy

[73] Assignee: U.S. Philips Corporation, New York, N.Y.

[21] Appl. No.: 256,108

[22] Filed: Oct. 11, 1988

Related U.S. Application Data

[63] Continuation of Ser. No. 1,736, Jan. 9, 1987, abandoned.

[30] Foreign Application Priority Data

Jan. 10, 1986 [IT] Italy ..... 67018 A/86
Nov. 19, 1986 [NL] Netherlands ..... 8602928

[51] Int. Cl.[4] ..... H01J 5/48
[52] U.S. Cl. ..... 313/318; 439/375
[58] Field of Search ..... 313/318, 51; 439/56, 439/220, 375

[56] References Cited

U.S. PATENT DOCUMENTS 3,622,947 11/1971 Griffin ..... 313/318
3,631,379 12/1971 Wright ..... 313/318
4,521,485 6/1985 Tondre et al. ..... 174/110 R

FOREIGN PATENT DOCUMENTS 1380720 1/1975 United Kingdom .

*Primary Examiner*—Robert L. Griffin
*Assistant Examiner*—T. Salindong
*Attorney, Agent, or Firm*—Norman N. Spain

[57] ABSTRACT

The electric lamp has a lamp vessel (1) having an end portion (3) which is fixed inthe lamp cap (5) by means of polyethersulphone (8) as a thermoplastic synthetic resin, which has adhered both to the lamp vessel and to the lamp cap. The end portion (3) has non-circular cross-sections where it is in contact with the synthetic resin (8) due to projections (10) projecting into the synthetic resin (8). A current supply wire (11) can be clamped between the synthetic resin (8) and the sheath portion (6) of the lamp cap (5) in order to establish electrical contact therewith. The lamp can be assembled by arranging in the hot state of the end portion (3) a polyethersulphone ring (8) around this end portion (3) and by providing the lamp cap (5) in the hot state around the polyethersulphone ring (8). FIG. 1.

8 Claims, 2 Drawing Sheets

ELECTRIC LAMP AND METHOD OF MANUFACTURING SAME

This is a continuation of application Ser. No. 001,736 filed Jan. 9, 1987, now abandoned.

BACKGROUND OF THE INVENTION

The invention relates to an electric lamp provided with:

- a translucent lamp vessel having an axis and an end portion,
- a light source in the lamp vessel,
- a lamp cap comprising a sheath portion and a base portion, in which an end portion of the lamp vessel is fixed by means of a polyethersulphone synthetic resin member in that the synthetic resin member adheres both to the lamp vessel and to the lamp cap, said lamp cap having an electric contact to which a current supply conductor to the light source is connected.

The invention further relates to the manufacture of such a lamp. Such a lamp is known from British Patent Specification 1,380,720.

In the known lamp, a ring of polyethersulphone is arranged to surround the end portion of the lamp vessel and is caused to melt. Subsequently, the lamp cap is provided and a butt joint is obtained between the lamp vessel and the lamp cap by cooling the assembly.

It has been found that with the use of this synthetic resin lamps are obtained which do not satisfy the IEC standard. Especially the adhesion of the resin to the lamp vessel is too poor for the requirements imposed on the torsional strength of the connection between the lamp vessel and the lamp cap.

BRIEF SUMMARY OF THE INVENTION

The invention has for its object to provide an electric lamp of the kind mentioned in the opening paragraph which can readily be manufactured and of which the connection between the lamp vessel and the lamp cap has an improved torsional strength.

According to the invention, this object is achieved in an electric lamp described in the opening paragraph in which the synthetic resin member connects in directions transverse to the axis of the lamp vessel the end portion of the lamp vessel to the lamp cap and in which the end portion of the lamp vessel has non-circular cross-sections transverse to the axis of the lamp vessel where it is in contact with the synthetic resin.

DETAILED DESCRIPTION OF THE INVENTION

Figure 1:
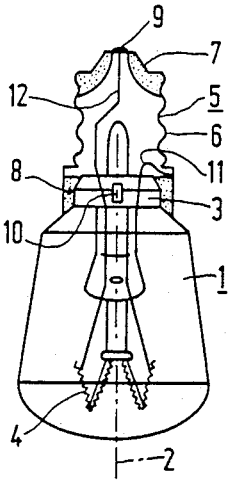
FIG. 1 shows a lamp of the invention in side elevation with the lamp cap in longitudinal sectional view.

In the lamp according to the invention, the synthetic resin member connects in radial directions, i.e. directions transverse to the axis of the lamp vessel, the end portion of the lamp vessel to the lamp cap. As a result, there is a comparatively large surface of application for the synthetic resin member to both the lamp vessel and the lamp cap. Moreover, size differences in these components are more readily neutralized and the lamp cap can be more readily positioned correctly coaxially to the lamp vessel. The lamp vessel, the synthetic resin member and the lamp cap are then arranged substantially coaxially.

The torsional strength of the connection between the lamp vessel and the lamp cap is materially improved as compared to the known lamp, due to the fact that the end portion of the lamp vessel is non-circular in cross-sections transverse to the axis of the lamp vessel. For example, the end portion may be oval or may have one or more depressions, for example transversal or axial grooves, in which the synthetic resin member adheres and which are filled with the synthetic resin. The end portion can have a projection which extends transversely to the axis of the lamp vessel and projects into the synthetic resin member. Such a projection neutralizes shearing forces in the interface between the lamp cap and the synthetic resin member. The uniformity of the forces in this interface is larger when several, for example two or more, of such projections are distributed along the circumference of the end portion. Such projections are readily obtained during the operation in which the end portion of the lamp vessel is shaped. This operation is a normal step in the manufacture of conventional lamps whose lamp vessel is fixed in the lamp cap by means of cement. The projections have a particular advantage, which will be stated hereinafter.

The adhesion of the synthetic resin member to the material of the lamp cap, generally metal, for example copper alloys, such as copper-nickel, brass or tombak, stainless steel, aluminum, new silver or nickel-plated metals, is generally stronger than to glass of the lamp vessel. Nevertheless, the inner surface of the lamp cap where it is in contact with the synthetic resin can be profiled to enlarge the application of the synthetic resin thereto. A good possibility is to use for this purpose an inwardly depressed metal lamp cap. The depression(s) is (are) then at least tangentially enclosed in the synthetic resin.

In a particular embodiment of the lamp according to the invention, a current supply conductor to the light source is clamped between the synthetic resin and the sheath of the lamp cap. In lamp caps having a metal sheath, it has surprisingly been found that a good electrical contact between this sheath and this conductor is obtained. In fact it has been found that it is possible in this manner, for example with Swan-s lamp caps, i.e. Swan lamp caps having only one contact at the base portion and one contact at the sheath, and with Edison lamp caps to connect the contact at the sheath of the lamp cap to a current supply conductor without using a soldering or welding operation. This means a very considerable simplification and acceleration of the manufacturing process, the more so as a current conductor emerging from the lamp over the edge of its cap can be situated at any point along the circumference of this edge. This is in contrast with a current conductor that can emerge from the base portion of the lamp cap only at one given area. Therefore, before this current conductor can be fixed, it has first to be ascertained where this conductor is situated. Another important advantage is that the relevant current supply conductor is now allowed to be so short that it does not emerge from the lamp cap. A loose wire outside the lamp cap, which may be touched in conventional lamps while it is alive, is not possible in this embodiment in which the current supply conductor remains inside the lamp cap. This embodiment renders welding or soldering of contacts entirely superfluous in lamps having two lamp caps each having a sheath contact, such as in a lamp having festoon caps.

Figure 6:
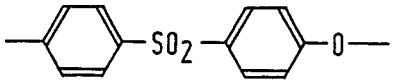
FIG. 6 shows the structural formula of a unit of a polyetheresulfone employed in the method of the invention.

Very satisfactory results are attained with at least substantially aromatic polyethersulphones, marketed under the tradename Victrex by ICI and having the structure of a repeating unit shown in FIG. 6 of the drawings. The polyethersulphones may have a filling of mineral powders, such as $SiO_2$, $CaCO_3$, MgO, ZnO, $BaSO_4$, $Al_2O_3$, but alternatively of fibres, such as glass fibres.

The lamp according to the invention may be one of several kinds, for example an incandescent lamp, in which the light source is a filament. The filament may be surrounded by an inner bulb which is arranged in the lamp vessel. The lamp may alternatively be a discharge lamp, for example a low-pressure discharge lamp, such as a low-pressure mercury discharge lamp. The light source is in this case an ionizable mercury-containing gas with electrodes that may be arranged in the lamp vessel. Inside the lamp vessel, the gas filling may be present in an inner bulb, such as in a low-pressure sodium discharge lamp. The lamp may alternatively be a high-pressure discharge lamp, such as a high-pressure sodium discharge lamp, which emits at least substantially white light. The light source is in this case a sodium-containing ionizable gas in a crystalline inner bulb provided with electrodes.

The lamp according to the invention can be very readily manufactured. It has proved to be favorable to arrange a preformed ring of the polyethersulphone around the hot end portion of the lamp vessel. It is favourable to carry out this step while this end portion is still hot, for example has a temperature of 400°–450° C. due to the operation in which this portion is shaped. In an embodiment of the method, the ring is brought to an elevated temperature, for example 150°–200° C. The ring adheres, when it is provided, to the hot surface of the end portion. If desired, the ring around the end portion may then be shaped by means of a jig. The jig may have an elevated temperature, for example of 150°–200° C. Subsequently, the lamp cap is provided. The lamp cap is heated for this purpose at a temperature of about 400°–450° C. The temperatures are not critical. At temperatures at the level of 400° C., the synthetic resin material rapidly softens and adheres. At temperatures at the level of 200° C., the ring retains its shape and does not adhere to objects with which it is in contact. On adhesion to objects at a temperature of about 400° C., a connection is obtained which becomes stronger upon cooling.

When a current supply conductor is bent around the ring provided on the end portion, an electrical connection is obtained with the lamp cap during the step of providing the lamp cap if this lamp cap has a metal sheath. These steps of connecting the cap and making an electrical contact require only a few, for example 3 to 4 seconds, while, when using a conventional cement, times of up to 25 seconds are required for curing the cement only. As a result, in conventional lamps, the step of mounting the lamp cap is one of the slowest assembling steps, so a material improvement is achieved by use of the invention.

The ring of synthetic resin has in a favorable embodiment a conical shape, for example with an apic angle of $2\times5°$. This shape facilitates the step of providing the ring around the end portion of the lamp vessel. In many cases, the lamp vessel is moreover conical at the free end of its end portion, because glass mouldings cannot be made with sharp shapes.

One or more projections at the end portion of the lamp vessel are particularly favorable means for enlarging the grip of the synthetic resin on the lamp vessel. The ring of synthetic resin can then have at its inner surface one or more grooves, which are caused to engage these projections. A ring having a smaller wall thickness can be used while maintaining its enlarged grip if this ring has at its wide end one or more recesses with which the ring laterally engages a projection. These embodiments make it possible to provide the ring around the end portion in a simple manner, by slipping the ring onto the end portion while requiring only a small quantity of synthetic resin. Similar recesses at the narrow end of the ring or grooves in the outer surface of the ring may be present to receive inward depressions in the lamp cap.

EU PS 186, 827 A2 discloses a lamp of pressed glass whose lamp cap is connected via a skirt of synthetic resin to the bottom of the lamp vessel. The sleeve then replaces a metal collar and a glass body through which in conventional lamps of pressed glass the bottom of the lamp vessel is connected to the lamp cap. The skirt of synthetic resin has a wide collar portion with longitudinal slots and internal nose-shaped projections, which under elastic deformation of the collar portion are caused to engage cavities in the bottom of the lamp vessel. As a result, a mechanical coupling is obtained between the lamp vessel and the skirt. At its outer surface the skirt has parts of screw-thread onto which the Edison lamp cap is screwed, while it further has in its outer surface recesses in which the lamp cap is depressed in order to lock the screw connection between the skirt and the lamp cap against displacement. The skirt is consequently secured mechanically both to the lamp vessel and to the lamp cap. The skirt is more than a means for coupling the lamp vessel to the lamp cap. It is an insulator body between the lamp vessel and the lamp cap and a body which causes the length of the lamp to be considerably greater than in the case of a direct connection of the lamp cap to the lamp vessel. The synthetic resins that can be used for the sleeve include polyethersulphones.

An embodiment of the lamp and the method according to the invention will be described more fully with reference to the drawing.

Figure 3:
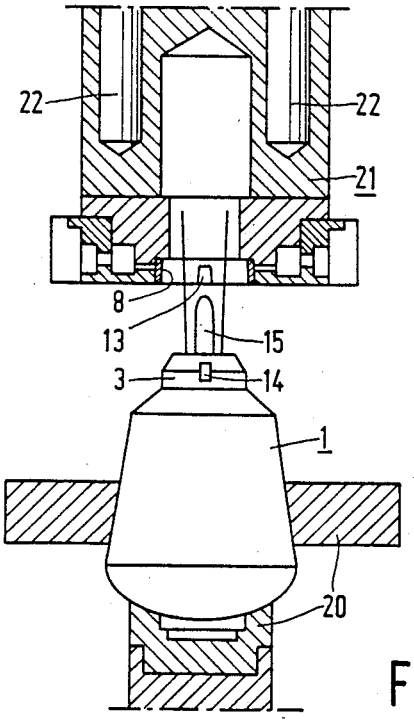
FIG. 3, FIG. 4 and FIG. 5 are each cross-sectional views showing a first, a second and a third step in the method of mounting the lamp cap according to the invention.

As shown in FIG. 3 this lamp has a translucent glass lamp vessel 1 having an axis 2 and an end portion 3. A filament 4 serving as the light source is arranged in the lamp vessel 1. In the lamp cap 5, which has a sheath portion 6 and base portion 7, the end portion 3 of the lamp vessel 1 is fixed by means of a thermoplastic synthetic resin member 8 so that the synthetic resin member adheres both to the lamp vessel and to the lamp cap. The lamp cap 5 has an electrical contact at the sheath 6 to which a current supply conductor 11 to the light source 4 is connected. A base contact 9 at the base portion 7 is connected to a second current supply conductor 12 to the light source 4. As the thermoplastic synthetic resin use is made of polyethersulfone containing 30% by weight of glass fibre.

The synthetic resin member 8 bonds the end portion 3 of the lamp vessel 1 in directions transverse to the axis 2 of the lamp vessel 1 to this lamp vessel. The synthetic resin member 8 and the lamp cap 5 consequently surround the end portion 3 and the synthetic resin member 8, respectively, substantially coaxially.

Figure 5:
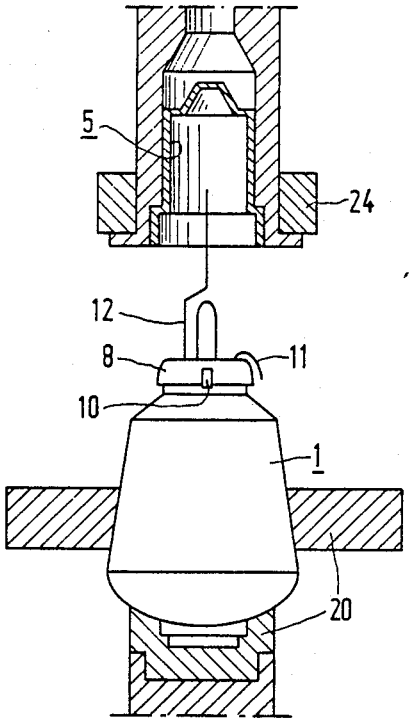

The end portion 3 has non-circular cross-sections transverse to the axis 2 of the lamp vessel 1 in which the end portion 3 is in contact with the synthetic resin. In the embodiments shown in FIG. 1, this non-circularity is due to a projection 10 which extends transversely to the axis 2 and projects into the synthetic resin member 8 (FIG. 5).

Although this is not visible in FIG. 1, the end portion 3 has diametrically opposite to the projection 10 a second similar projection (14 in FIG. 3). The projections 10, 14 are distributed regularly along the circumference of end portion 3.

The current supply conductor 11 is in electrical contact with the lamp cap 5 on the inner side of this lamp cap due to the fact that this conductor 11 is clamped between the synthetic resin member 8 and the sheath portion 6 of the lamp cap 5.

Figure 2:
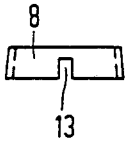
FIG. 2 shows a cross-sectional view of a thermoplastic synthetic resin ring used in lamps of the FIG. 1.

The synthetic resin member 8 employed in the lamp of FIG. 1 is a conical ring, the wide end of which is provided with two diametrically opposed recesses of which only one, 13, is shown in FIG. 2, a cross-sectional view of said ring.

The synthetic resin employed in the member 8 is a polyethersulfone, the structural formula of a unit of which is shown in FIG. 6.

Steps in a method of mounting the lamp cap according to the invention will now be described with reference to FIG. 1, FIG. 2 and FIG. 3.

In FIG. 3, the lamp vessel 1 is shown rotated through 180° with respect to FIG. 1 and is held in position by a holder 20. The end portion 3 has a temperature of 400° to 450° C. due to a shaping and cleaning process, at the end of which process the lamp vessel 1 was sealed in a vacuum-tight manner by closing the exhaust tube 15. A thermoplastic synthetic resin ring 8 heated at about 150°–200° C. is situated in a holder 21 accommodating heating elements 22. The holders 20, 21 are moved towards each other and the ring 8 is pressed on the end portion 3, the ring melting at its inner surface and adhering to the end portion 3. The recesses 13 in the ring 8 then engage the projections 10, 14. The ring consequently has a profile cooperating with the non-circular cross-sections of the end portion 3. Similar recesses may be present at the narrow end of the ring 8 in order to cooperate with depressions that may be present in the lamp cap 5.

Figure 4:
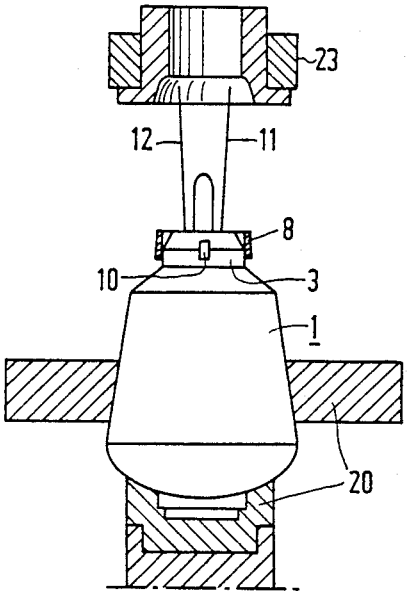

A shaper 23 in FIG. 4, which internally is oversized with respect to the interior of the lamp cap 5, is moved to the holder 20 to shape the external surface of the thermoplastic synthetic resin ring 8.

After the current supply conductor 11 has been shortened and bent and the current supply conductor 12 has been aligned substantially coaxially, a holder 24 (FIG. 5) with a lamp cap 5 shown diagrammatically, which is heated by means of, for example, a flame to a temperature of about 400° to 450° C., is pressed on the ring 8, this ring melting at its outer surface and adhering to the sheath portion 6 (shown in FIG. 1) of the lamp cap 5. After the holder 24 is removed, the connection of the base contact 9 (shown in FIG. 1) with the current supply conductor 12 can be made and the lamp may be cooled by means of an air jet.

Alternatively, the current supply conductor 11 may be shortened before the ring 8 is mounted in the step shown in FIG. 3.

What is claimed is:

1. An electric lamp provided with:
   a translucent lamp vessel having an axis and an end portion,
   a light source in the lamp vessel,
   a lamp cap having a sheath portion and a base portion in which said end portion of the lamp vessel is adhesively bound by means of a polyethersulfone synthetic resin member which member adheres both to the lamp vessel and to the lamp cap, said lamp cap having an electrical contact to which a current supply conductor to the light source is connected, characterized in that the synthetic resin member is positioned between said lamp cap and said end of the lamp vessel, contacts said end portion of the lamp vessel, and connects the end portion of the lamp vessel to the lamp cap in directions transverse to said axis of the lamp vessel and in that the end portion of the lamp vessel has non-circular cross-sections transverse to said axis of the lamp vessel where it is in contact with the synthetic resin member.

2. An electric lamp as claimed in claim 1, characterized in that the end portion of the lamp vessel has a projection which extends transversely to the axis of the lamp vessel and projects into the synthetic resin member.

3. An electric lamp as claimed in claim 2, characterized in that the lamp vessel has several of said projections distributed over the circumference of the end portion.

4. An electric lamp as claimed in claim 1, 2 or 3, characterized in that a current supply conductor to the light source is electrically connected to the sheath portion of the lamp cap and this conductor is clamped between the synthetic resin member and the sheath portion of the lamp cap.

5. A method of manufacturing an electric lamp provided with:
   a translucent lamp vessel having an axis and an end portion,
   a light source in the lamp vessel,
   a lamp cap having a sheath portion and a base portion in which said end portion of the lamp vessel is adhesively bound by means of a polyethersulfone synthetic resin member which member adheres both to the lamp vessel and to the lamp cap, said lamp cap having an electrical contact to which a current supply conductor to the light source is connected,
   the synthetic resin member connecting the end portion of the lamp vessel to the lamp cap in directions transverse to said axis of the lamp vessel and the end portion of the lamp vessel having non-circular cross-sections transverse to the axis of the lamp vessel where it is in contact with the synthetic resin member,
   characterized in that a polyethersulfone ring is positioned to surround and contact an end portion of the lamp vessel heated to a temperature of about 400°–450° C., and in that a lamp cap heated to a temperature of about 400°–450° C. is positioned to surround and contact the polyethersulfone ring.

6. A method as claimed in claim 5, characterized in that the ring is applied at a temperature of about 150°–200° C.

7. A method as claimed in claim 5 or 6, characterized in that the polyethersulphone ring is conical.

8. A method as claimed in claim 5, characterized in that the end portion has at least one projection extending transversely to the axis of the lamp vessel, and in that a ring is used which has at least one recess for this projection.

* * * * *